United States Patent [19]

Matsumoto et al.

[11] 4,113,053

[45] Sep. 12, 1978

[54] SOUND ABSORBING BODY

[75] Inventors: Masayasu Matsumoto, Zushi; Kazuyoshi Iida, Yokohama; Yoshikazu Kondo, Yokohama; Shosuke Suzuki, Yokohama, all of Japan

[73] Assignee: Bridgestone Tire Company Limited, Tokyo, Japan

[21] Appl. No.: 730,115

[22] Filed: Oct. 6, 1976

[51] Int. Cl.[2] ..... E04B 2/00; G10K 11/00

[52] U.S. Cl. ..... 181/284; 181/286; 181/288; 181/293

[58] Field of Search ..... 181/204, 213, 214, 222, 181/224, 285, 286, 292, 293, 284

[56] References Cited

U.S. PATENT DOCUMENTS

| | | | |
|---|---|---|---|
| 2,057,731 | 10/1936 | Munroe et al. | 181/288 |
| 3,850,261 | 11/1974 | Hehmann et al. | 181/288 |
| 3,895,686 | 7/1975 | Savkar et al. | 181/224 |
| 3,948,346 | 4/1976 | Schindler | 181/292 |

*Primary Examiner*—L. T. Hix
*Assistant Examiner*—Benjamin R. Fuller
*Attorney, Agent, or Firm*—Sughrue, Rothwell, Mion, Zinn and Macpeak

[57] ABSTRACT

A sound absorbing body which can effectively be utilized as an exterior sound absorbing wall or an interior wall of a house is disclosed. The sound absorbing body comprises a number of sound absorbing cavities inclined at an angle $\alpha$ which is smaller than 80° with respect to a transverse horizontal sectional plane of the body, the sound absorbing cavities being opened at the sound incident surface.

5 Claims, 11 Drawing Figures

SOUND ABSORBING BODY

This invention relates to a sound absorbing body which can effectively be utilized as an exterior sound absorbing wall or as an interior wall of a house.

A sound absorbing material used for the exterior sound absorbing wall or the interior wall of the house is required not only to have a high acoustic absorptivity over a wide sound frequency range from a low sound frequency to a high sound frequency, but also to have an excellent weather resistant property, water resistant property, etc. when the sound absorbing body is used as the exterior sound absorbing wall exposed to atmospheric conditions. Rock wool, glass wool, etc. used in general as the sound absorbing material has a poor weather resistant property and water resistant property, so that it is difficult to maintain its sound absorbing property for a long time.

A honeycomb-shaped or slit-shaped sound absorbing body which makes use of resonance has a excellent weather resistant property and water resistant property and exhibits a high sound absorbing property for sound having a given sound frequency, but the sound absorbing property thereof is generally bad. Such sound absorbing body, therefore, could not satisfactorily be used in practice as a sound absorbing wall for absorbing noises having a wide sound frequency range.

An object of the invention, therefore, is to provide an improved and novel sound absorbing body which can be used as an exterior sound absorbing wall exposed to atmospheric conditions for a long time and can reveal a high sound absorbing property over a wide sound frequency range from a low sound frequency to a high sound frequency.

A feature of the invention is the provision of a sound absorbing body comprising a number of sound absorbing cavities inclined at an angle which is smaller than 80° with respect to a transverse horizontal sectional plane of the body, said sound absorbing cavities being opened at the sound incident surface.

The sound absorbing body according to the invention may be used not only as a sound absorbing material of an exterior sound absorbing wall arranged at the outdoors, but also for various kinds of purposes such, for example, as a sound absorbing material of an interior wall of a sound insulating house.

The invention will be described in greater detail with reference to the accompanying drawings, wherein.

Figure 1:
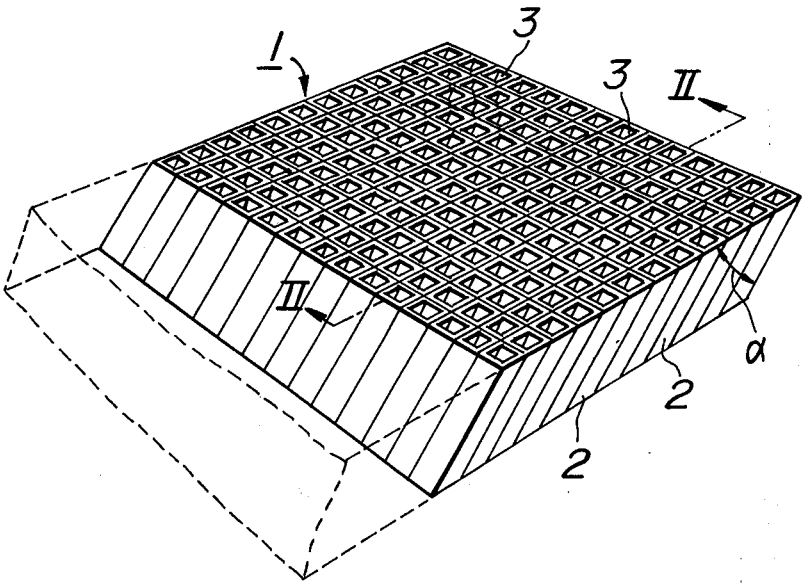
FIG. 1 is a perspective view showing a part of one embodiment of the sound absorbing body according to the invention.
Figure 2:
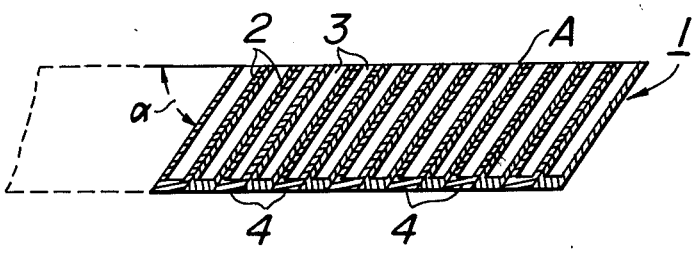
FIG. 2 is a cross-sectional view taken on line II—II of FIG. 1.

Referring to FIGS. 1 and 2, reference numeral 1 designates a sound absorbing body composed of a honeycomb-shaped body including a number of sound absorbing members 2 formed of synthetic resin material, and arranged in parallel with each other along a given direction. These sound absorbing members 2 are opened at a sound incident surface A which is parallel with a transverse horizontal sectional plane X—X of the body 1 and inclined at an angle $\alpha$ with respect to the transverse horizontal sectional plane X—X of the body 1 so as to form a number of sound absorbing cavities 3 also inclined at the angle $\alpha$ with respect to the transverse horizontal sectional plane X—X of the body 1.

In the present embodiment, the sound absorbing member 2 for forming the sound absorbing cavity 3 has an opening which is square in section. This opening may be modified into circular, rectangular or any other deformed contours in section. In addition, the sound incident surface A may be made zigzag or wavy surface.

The sound absorbing cavity 3 may preferably have a cross-sectional area of the order of several tens $mm^2$ and a depth of the order of several tens mm.

The sound absorbing member 2 may be formed of any suitable material other than the above mentioned synthetic resin material, such, for example, as metal material, inorganic material, etc. Most of the porous inorganic material per se have an excellent sound absorbing property, so that a favourable result can be obtained by using a sound absorbing member 2 formed of such porous inorganic material such as concrete.

The angle $\alpha$ of the sound absorbing cavity 3 with respect to the transverse horizontal sectional plane X—X of the body 1 should preferably be smaller than 80°. If the angle $\alpha$ is gradually decreased, the sound absorbing property or the lower sound frequency of the sound absorbing cavity 3 becomes improved without exerting any bad influence upon the sound absorbing property for the higher sound frequency. As a result, the sound absorbing cavity 3 inclined at a smaller angle $\alpha$ with respect to the transverse horizontal sectional plane X—X of the body 1 has a tendency to improve the sound absorbing property thereto over a wide sound frequency range. Thus, it is preferable to make the angle $\alpha$ somewhat small.

Figure 3:
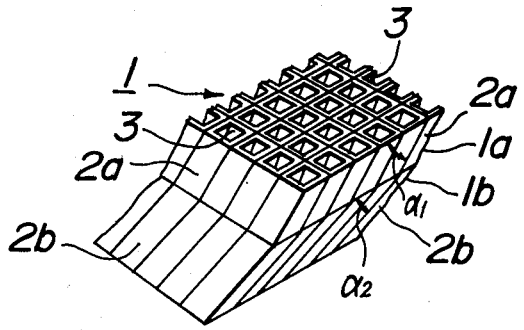
FIG. 3 is a perspective view showing a part of another embodiment of the sound absorbing body according to the invention.

It FIG. 3 is shown another embodiment of the sound absorbing body according to the invention. In the present embodiment, a sound absorbing body 1 is composed of two honeycomb-shaped bodies 1*a* and 1*b* superimposed one upon the other. The upper honeycomb-shaped body 1a includes a number of sound absorbing members 2*a* inclined at an angle $\alpha_1$ with respect to the transverse horizontal sectional plane of the body 1a so as to form a number of sound absorbing cavities 3 also inclined at the angle $\alpha_1$ with respect to the transverse horizontal sectional plane of the body 1*a*. The lower honeycomb-shaped body 1b includes a number of sound absorbing members 2b inclined at an angle $\alpha_2$ with respect to the transverse horizontal sectional plane of the body 1b, the angle $\alpha_2$ being smaller than the angle $\alpha_1$ thus forming a number of sound absorbing cavities 3 also inclined at the angle 60 $_2$ with respect to the transverse horizontal sectional plane of the body 1b.

The sound absorbing body constructed as above described is excellent in the sound absorbing property for the high sound frequency range and becomes significantly improved in the sound absorbing property for the low sound frequency range. As a result, the present embodiment provides a favourable sound absorbing body having a high sound absorbing property over a wide sound frequency range.

Figure 4:
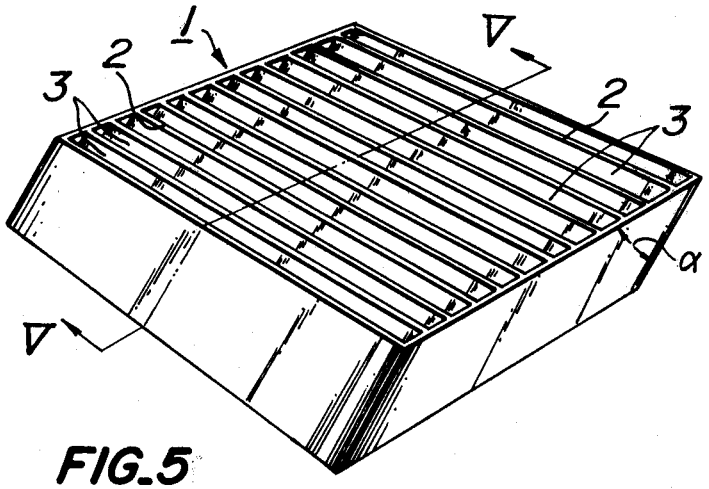
FIG. 4 is a perspective view showing a part of a further embodiment of the sound absorbing body according to the invention.
Figure 5:
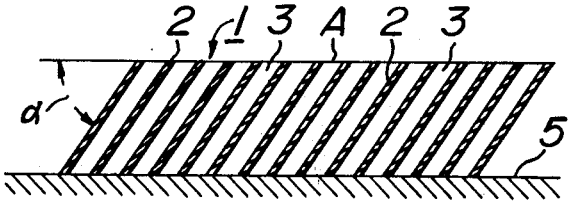
FIG. 5 is a cross-sectional view taken on line V—V of FIG. 4.

The sound absorbing boy according to the invention may preferably be arranged closely adjacent to the wall surface of a sound insulating wall. If the wall surface of the sound insulating wall is not used, the sound absorbing members 2 are closed at a base portion 4 thereof so as to form a sound absorbing cavities 3 closed at one end thereof as shown in FIG. 2.

in FIG. 4 is shown a further embodiment of the sound absorbing body according to the invention. In the present embodiment, a sound absorbing body 1 is composed of a slit-shaped body including a number of plate-shaped sound absorbing members 2 spaced apart from each other and arranged in parallel with each other. These sound absorbing members 2 are opened at a sound incident surface A which is also parallel with the transverse horizontal sectional plane X—X and inclined at an angle $\alpha$ with respect to the transverse horizontal sectional plane X—X so as to form a number of sound absorbing cavities 3 also inclined at the angle $\alpha$ with respect to the transverse horizontal sectional plane X—X.

Sound propagated in a direction perpendicular to the transverse horizontal sectional plane X—X is incident upon the sound absorbing cavities 3 inclined at an angle $\alpha$ with respect to the transvers horizontal sectional plane X—X. As a result, the normal acoustic impedance at the boundary surface is improved and the incident sound is effectively absorbed in the sound absorbing cavities 3. As can be seen from the above, the adjustment of the angle $\alpha$ provides a sound absorbing body which can exhibit a high sound absorbing property over a wide sound frequency range.

The invention will now be described with reference to the following examples which illustrate experimental tests on different embodiments of the sound absorbing body according to the invention compared with existing sound absorbing bodies.

EXAMPLE 1

Figure 6A:
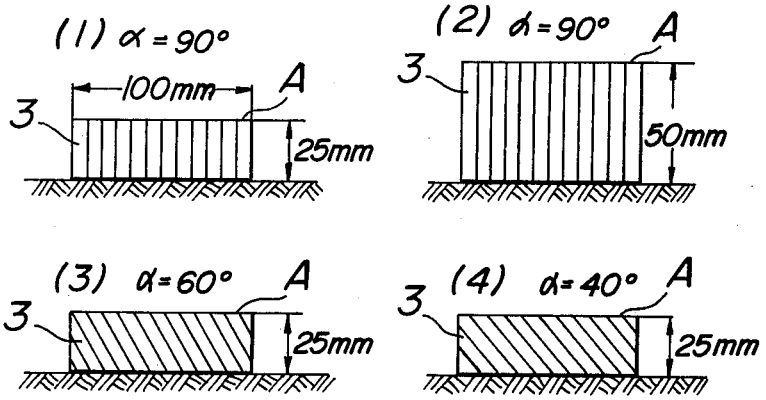
FIG. 6A is cross-sectional views showing four different sound absorbing bodies to be tested.
Figure 6B:
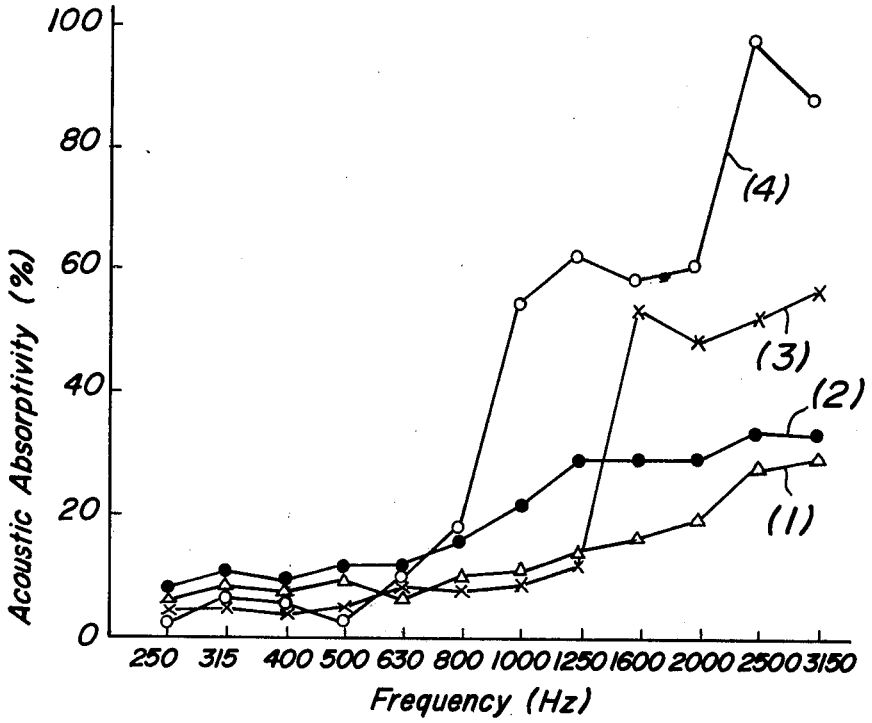
FIG. 6B is a graph illustrating the test result yielded from the tests on the four different sound absorbing bodies shown in FIG. 6A.

As shown in FIG. 6A, provision is made of the following four different types of sound absorbing bodies (1), (2), (3) and (4). The sound absorbing body (1) is composed of a number of sound absorbing cavities 3 inclined at an angle of 90° with respect to a sound incident surface A which is in parallel with a transverse horizontal sectional plane X—X and having a depth of 25 mm. The sound absorbing body (2) is composed of a number of sound absorbing cavities 3 inclined also at an angle $\alpha$ of 90° with respect to the transverse horizontal sectional plane, but having a depth of 50 mm. The sound absorbing body (3) is composed of a number of sound absorbing cavities 3 inclined at an angle $\alpha = 60°$ with respect to the transverse horizontal sectional plane, and having a depth of 25 mm. The sound absorbing body (4) is composed of a number of sound absorbing cavities 3 inclined at an angle $\alpha = 40°$ with respect to the transverse horizontal sectional plane and having a depth of 25 mm. All of these sound absorbing bodies (1), (2), (3) and (4) have the same width of 100 mm. Sound was incident upon the transverse horizontal sectional plane X—X of these sound absorbing bodies (1), (2), (3) and (4) in a direction perpendicular thereto and the acoustic absorptivity thereof was measured. The result thus measured is shown in FIG. 6B. The sound absorbing member of all of these sound absorbing bodies (1), (2), (3) and (4) was formed of polyethylene resin, had a thickness of 1 mm, and a square opening whose cross-sectional area was 25 mm$^2$.

In FIG. 6B, a curve plotted through measured points denoted by a symbol Δ shows the result yielded from the tested sound absorbing body (1), a curve plotted through measured points denoted by a symbol • shows the result obtained from the tested sound absorbing body (2), a curve plotted through measured points denoted by a symbol *x* shows the result yielded from the tested sound absorbing body (3) and a curve plotted through measured points denoted by a symbol o shows the result obtained from the tested sound absorbing body (4).

As can be seen from FIG. 6B, the sound absorbing bodies (1) and (2) whose sound absorbing cavities 3 are inclined at an angle $\alpha = 90°$ with respect to the transverse horizontal sectional plane X—X are inferior in sound absorbing property to the sound absorbing bodies (3) and (4) according to the invention whose sound absorbing cavities 3 are inclined at an angle of smaller than 80° with respect to the transverse horizontal sectional plane X—X. In the sound absorbing bodies (1) and (2), an inconsiderably slight improvment in the sound absorbing property can be obtained by making the depth of the sound absorbing body (2) larger than that of the sound absorbing body (1). On the contrary, in the sound absorbing bodies according to the invention (3) and (4), it is possible to significantly improve the sound absorbing property thereof if compared with that of the sound absorbing bodies (1) and (2). In addition, if the angle $\alpha$ is made small, the sound absorbing property for the low sound frequency becomes improved and a high sound absorbing property can be obtained over a wide sound frequency range.

Example 2

Figure 7A:
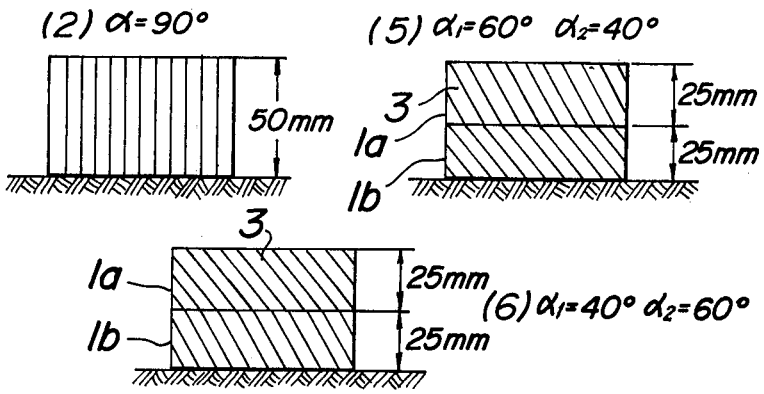
FIG. 7A is cross-sectional views showing one of the sound absorbing bodies shown in FIG. 6A and two another different sound absorbing bodies to be tested.

As shown in FIG. 7A, in the present example, provision is made of sound absorbing bodies (5) and (6) composed of two honeycomb-shaped bodies superimposed one upon the other in the same manner as that shown in FIG. 3. In the sound absorbing body (5), the sound absorbing cavities 3 of the upper honeycomb-shaped body 1a is inclined at an angle $\alpha_1 = 60°$ with respect to the sound incident surface A, which is in parallel with the transverse horizontal sectional plane X—X, while the sound absorbing cavities 3 of the lower honeycomb-shaped body 1b is inclined at an angle $\alpha_2 = 40°$ with respect to the transverse horizontal sectional plane X—X.

In the sound absorbing body (6), the sound absorbing cavities 3 of the upper honeycomb-shaped body 1a is inclined at an angle of $\alpha_1 = 40°$ with respect to the transverse horizontal sectional plane X—X, while the sound absorbing cavities 3 of the lower honeycomb-shaped body 1b is inclined at an angle $\alpha_2 = 60°$ with respect to the transverse horizontal sectional plane X—X.

The acoustic absorptivity of these sound absorbing bodies (5) and (6) was measured and compared with that of the sound absorbing body (2). The result thus measured is shown in FIG. 7B.

Figure 7B:
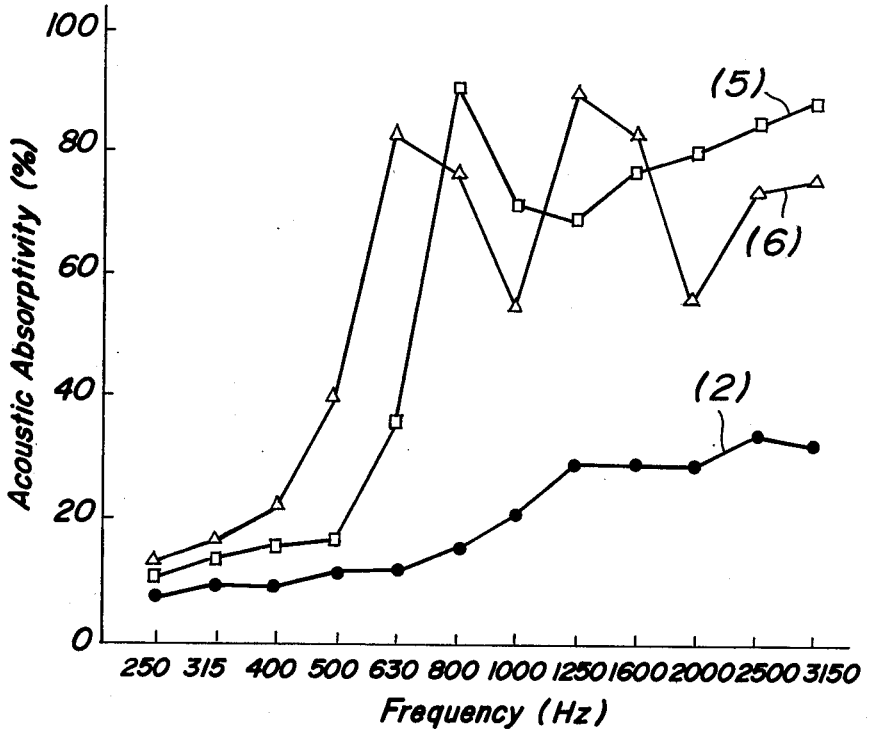
FIG. 7B is a graph illustrating the test result yielded from the tests on the three different sound absorbing bodies shown in FIG. 7A.

In FIG. 7B, a curve plotted through measured points denoted by a symbol □ shows the result obtained from the tested sound absorbing body (5) and a curve plotted through measured points denoted by a symbol ▲ shows the result obtained from the tested sound absorbing body (6).

As can be seen from FIG. 7B, the sound absorbing bodies (5) and (6) composed of two different honeycomb-shaped bodies superimposed one upon the other are superior in sound absorbing property to the sound absorbing body (2) whose depth is the same as that of the sound absorbing bodies (5) and (6) and exhibit a high acoustic absorptivity over a wide sound frequency range from a low sound frequency to a high sound frequency.

EXAMPLE 3

In the present example, the sound absorbing body (4) used in the example 1 was disposed on an inorganic sound absorbing plate 8 formed of a sintered mixture of Shirasu (porous stony substance ejected from volcanoes), perlite, etc. and having a thickness of 25 mm to provide a sound absorbing body to be tested (7). The acoustic absorptivity of the sound absorbing body (7) was measured and the result obtained is shown in FIG. 8B.

Figure 8A:
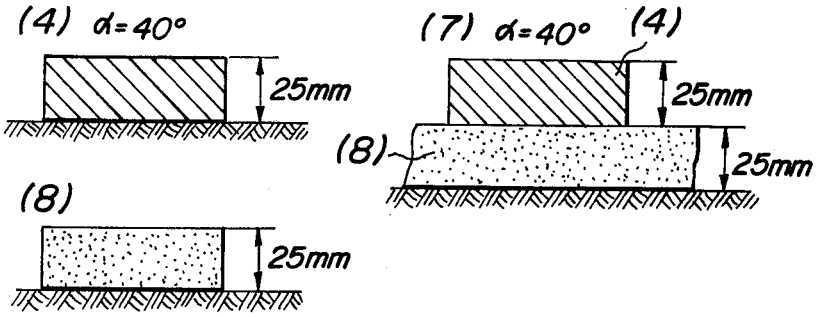
FIG. 8A is cross-sectional views showing one of the sound absorbing bodies shown in FIG. 6A and two further different sound absorbing bodies to be tested.
Figure 8B:
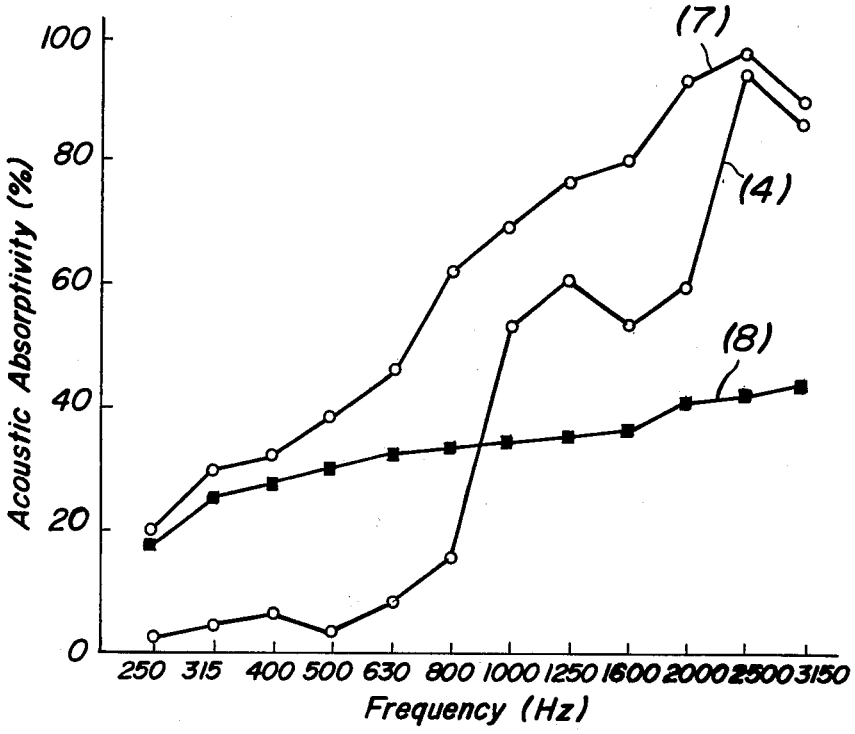
FIG. 8B is a graph illustrating the test result yielded from the tests on the three different sound absorbing bodies shown in FIG. 8A.

In FIG. 8B, a curve plotted through measured points denoted by a symbol ⊙ shows the result yielded from the tested sound absorbing body (7) and a curve plotted through measured points denoted by a symbol ■ shows the result obtained from the tested inorganic sound absorbing plate (8).

As seen from FIG. 8B, a combination of the sound absorbing body according to the invention and the conventional inorganic sound absorbing plate makes is possible to significantly improve the sound absorbing property of the latter.

As explained hereinbefore, the invention provides a sound absorbing body which exhibits a high acoustic absorptivity over a wide sound frequency range from a low sound frequency to a high sound frequency; which may be formed of material having an excellent wear resistant property and water resistant property and hence can maintain its high sound absorbing property for a long time; and which may easily be used together with existing sound insulating wall or sound absorbing plate.

The invention is not limited to the embodiments described above, but many modifications and alternations may be made. For example, a plurality of sound absorbing bodies according to the invention having different angles $\alpha_1, \alpha_2, \ldots \alpha_n$ may be superimposed one upon the other. In addition, the sound absorbing cavities 3 may be arranged at random. Moreover, a plurality of sound absorbing bodies having cavities which are different in section such, for example, as square, circular, rectangular in section, etc. from each other may be superimposed on upon the other.

What is claimed is:

1. A sound absorbing body comprising, a plurality of sound absorbing bodies superimposed one upon the other and each provided with a number of sound absorbing cavities inclined at an angle which is less than 80° with respect to a transverse horizontal sectional plane, the sound absorbing cavities of adjacent sound absorbing bodies being inclined at angles with respect to said transverse horizontal sectional plane which are different from each other, said sound absorbing cavities being opened at a sound incident surface and closed at base portions thereof.

2. A sound absorbing body as claimed in claim 1, wherein said sound absorbing body is disposed on a porous sound absorbing body.

3. A sound absorbing body as claimed in claim 1, wherein each of said number of sound absorbing cavities has an opening which is different in section such as square, circular, rectangular and any other deformed contour in section.

4. A sound absorbing body as claimed in claim 1, wherein said sound absorbing cavities are arranged at random.

5. A sound absorbing body as claimed in claim 1, wherein said sound absorbing cavities are approximately 20 mm in depth and approximately 20 $mm^2$ in cross-sectional area.

* * * * *